United States Patent [19]

Miller

[11] Patent Number: 4,701,599

[45] Date of Patent: Oct. 20, 1987

[54] INSULATION SYSTEM OF SHEATHED HEATING ELEMENTS

[75] Inventor: Walter E. Miller, Brockville,, Canada

[73] Assignee: Black & Decker Inc., Newark, Del.

[21] Appl. No.: 870,758

[22] Filed: Jun. 4, 1986

[30] Foreign Application Priority Data

Jun. 27, 1985 [CA] Canada ..... 485704

[51] Int. Cl.[4] ..... H05B 3/44; H01C 1/02

[52] U.S. Cl. ..... 219/544; 219/335; 219/336; 219/437; 338/238; 338/243; 338/273; 338/274; 29/611; 29/614; 29/615

[58] Field of Search ..... 219/336, 335, 437, 544; 338/238–243, 273, 274; 29/611, 614, 615

[56] References Cited

U.S. PATENT DOCUMENTS 3,412,358 11/1968 Hummel et al. ..... 338/7

*Primary Examiner*—E. A. Goldberg
*Assistant Examiner*—Gerald E. Preston
*Attorney, Agent, or Firm*—Edward D. Murphy; Paul J. Lerner; Edward D. C. Bartlett

[57] ABSTRACT

An improved copper sheathed heating element for installation in appliances, such as electric kettles, includes a minor amount of a silicone water-proofing agent admixed with magnesium oxide filler agent prior to the element being annealed. Annealing of the element is carried out at a reduced annealing temperature over an extended duration in order to limit thermal degradation of the additive during the annealing process. The resulting element achieves sufficient ductility for purposes of formation as a kettle heating element, while the insulation value of the element over an extended shelf life is maintained without significant degradation. Preferably, the silicone agent comprises polydimethylsiloxane and is present in the range 0.1 to 0.15 percent by weight.

9 Claims, 3 Drawing Figures

INSULATION SYSTEM OF SHEATHED HEATING ELEMENTS

FIELD OF THE INVENTION

This invention is directed to a process for providing an improved sheathed resistance heating element, and to improved heating elements provided by the process.

BACKGROUND OF THE INVENTION

Sheathed heating elements having a metal protective sheath and a filling of magnesium oxide powder as packing and insulation for the enclosed resistance element have been subject in the past to undesirable degradation of electrical insulation value during the usual shelf life of the elements.

The usual previous method of manufacturing such heating elements, in the case of copper covered elements, comprised the steps of threading the resistance wire in centered relation in a copper tube constituting the outside cover, followed by pouring powdered magnesium oxide as electrical insulation into the tube to separate the wire from the cover, followed by densification by compression of the magnesium oxide, with subsequent draw-extrusion of the element to a reduced sheath diameter, with consequent further densification of the insulation. The succeeding steps of the method then included heating the element in a furnace to a temperature in the order to 1200 degrees F for a period of 15 minutes followed by cooling in air in order to anneal the copper sheath. The thus annealed sheath could then be formed to close radii for purposes of utilizing the element. Elements produced by this process have suffered from an unacceptable number of rejects, the reject rate being adversely affected by the duration of storage and dampness of the shelf environment. Element rejects were due to a significant reduction in the insulation value of the magnesium oxide caused by the ingress of atmospheric moisture, leading to the failure of an unacceptable percentage of such elements to pass a high voltage ("high pot") test. Corrective action by baking the elements at 500 degrees F. for periods of up to 8 hours was required to remove some of the moisture from the elements before sealing. Even then a considerable amount of moisture remained which led to high current leakages.

One attempted method to counter such deterioration of insulation values has involved spraying of the open sheath ends with a sealer, known as circuit board sealer (DOW CORNING QR-4-3117.TM) for purposes of impeding the entry of moisture therein. This improvement met with only limited success. The treatment of magnesium oxide insulation with silicone sealant has previously been used with steel and aluminum clad elements that did not require annealing before being formed.

SUMMARY OF THE INVENTION

It is an object of the present invention to provide a sheathed heating element, particularly for a kettle or the like, having an improved shelf life with regard to satisfactory electrical insulation of the resistance element.

According to one aspect of the present invention, there is provided a method of making a sheathed resistance heating element, having improved moisture resistance, comprising the steps of treating powdered insulation filler agent by admixing a predetermined amount of silicone water-proofing agent with the powdered insulation filler agent, filling an elongated sheath containing a resistance wire with the treated powdered agent, densifying the powdered insulation by compression, and annealing the element at a predetermined optimum temperature, the quantity of water-proofing agent being sufficient to substantially preclude the establishment of moisture-initiated short-circuit tracks in the insulation.

From tests carried out on a substantial number of heating elements fabricated in accordance with the invention it was found that a significant improvement in sustained insulation value was obtained.

However, reduction of the annealing temperature from the customary 1200 degrees F., in order to minimize changes to the silicone additive, and annealing at temperatures of about 700 degrees F., with an extended furnace time of about four hours, achieved satisfactory reduction in sheath brittleness, and provided a consistently enhanced heating element wherein, under protracted humidity exposure, the degradation in insulation value was not practically significant.

Heat treatment of the improved element, at temperatures ranging upward to the previously customary 1200 degrees F. produced elements showing a marked improvement in insulation integrity over prior art untreated elements. However, the adoption of a significantly lower range of values for heat treatment produced more consistently enhanced values of sustained insulative value.

In regard to the degree of sheath ductility achieved, it will be understood that in certain applications of the heating element the sheath may require to be bent at a short radius of curvature, as small as even ⅜", without cracking or evident necking of the sheath occurring. Such high ductility requires the preferred 4 hour annealing period. Lower annealing temperatures than 700 degrees F. produced a statistically significant number of cracked or necked sheaths during the element deforming operation, in the case of short radius bends for electric kettle elements. Thus, a 650 degrees F. annealing temperature failed to provide consistently satisfactory results, at least in the case of elements requiring close forming for kettles.

Annealing at temperatures higher than 700 degrees F. for periods less than 4 hours could produce consistently satisfactory annealing of the elements, but with some reduction in the extent of insulation maintenance under high humidity test conditions; i.e. some insulation degradation.

For elements wherein service requirements do not require close radius bending, a lower annealing temperature such as 650 degrees F. may prove acceptable.

The reduced temperature anneal (i.e. annealing at approximately 700 degrees F. annealing temperature), obviated the essential need to seal the outer ends of the element with circuit board sealer. However, it was found that adoption of an end sealer such as circuit board sealer or any epoxy resin further enhanced the results obtained.

Other objects, features and advantages of the present invention will become more fully apparent from the following detailed description of the preferred embodiment, the appended claims and the accompanying drawing.

DETAILED DESCRIPTION OF THE PREFERRED EMBODIMENTS

Figure 1:
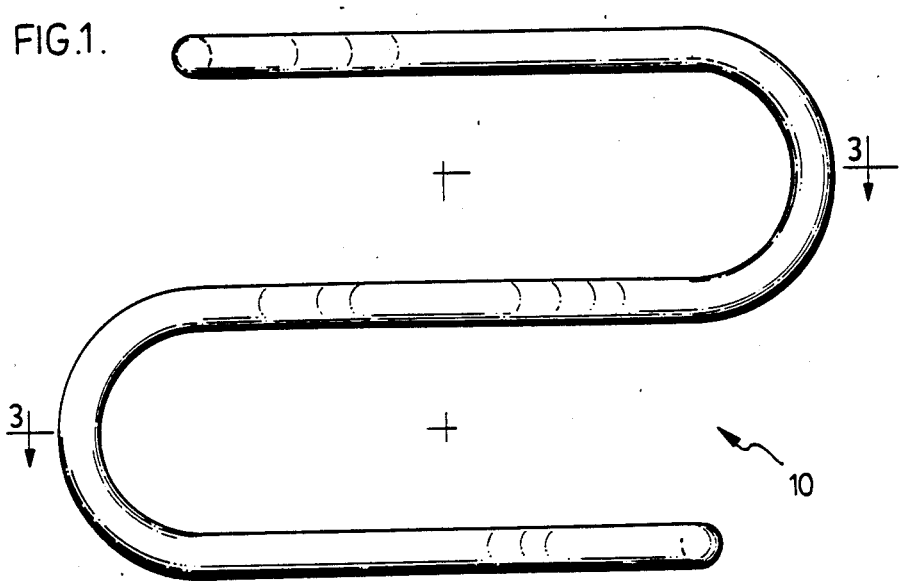
FIG. 1 is a plan view of a heating element in accordance with the present invention in a typical electric kettle embodiment.
Figure 2:
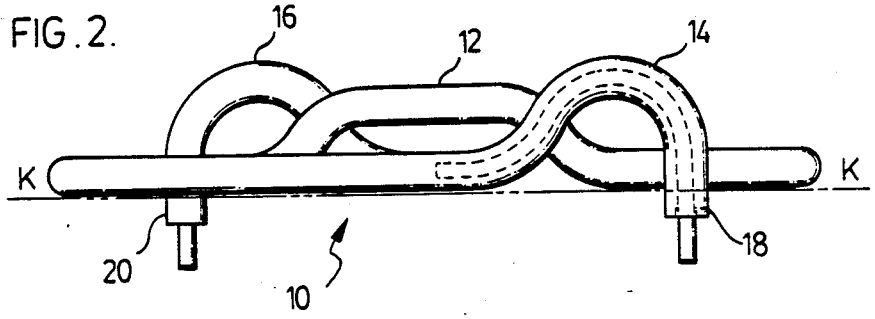
FIG. 2 is a side elevation of the element of FIG. 1.

Referring to FIGS. 1 and 2, the serpentine embodiment of a kettle heating element 10 includes an intermediate raised portion 12 and curved end portions 14, 16 terminating in downturned ends 18, 20. This particular embodiment is that used in an electric kettle, wherein K-K represents a kettle bottom through which the ends 18, 20 extend in brazed, soldered or welded sealed relation therewith.

From the convoluted profiles it will be seen that a heating element 10 of this type requires the application thereto of cold bends of varying radii, wherein adequate annealing is imperative, in order to avoid cracking or necking of the sheath when applying the various cold bending steps thereto in order to achieve the required form.

Figure 3:
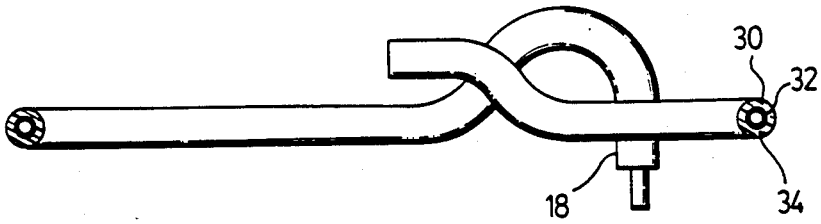
FIG. 3 is a section on the staggered line 3—3 of FIG. 1.

Referring to FIG. 3, the heating element construction comprises an outer copper sheath 30, an inner electrical resistance element 32 threaded therethrough, and the subject silicone impregnated insulation 34 packed and compressed between the element 32 and the sheath 30.

The powdered insulation 34 comprises magnesium oxide to which a silicone agent has been admixed in the range 0.1 to 0.15 percent by weight of the weight of the magnesium oxide. Preferably, the silicone agent comprises low viscosity polydimethylsiloxane fluid.

By virtue of the low temperature annealing process herein disclosed, the copper sheath 30 is rendered sufficiently ductile for the purposes of effecting close radius bends without cracking or undue necking, while the insulative and moisture repellency of the impregnated insulation 34 is maintained at a high standard.

Evaluation tests of ten of the subject rodded elements, in straight length and containing the silicone treated magnesium oxide, having been annealed at 700 degrees F. for approximately four hours, were carried out in a damp environment, at 90% relative humidity and 90 degrees F., to simulate a "worst possible condition" of a typical shelf life. The test extended for 56 days, with the insulation value being checked every two weeks. At the end of the test the two ends of each rodded element were trimmed back a distance of one inch, so as to remove the highest moisture contaminated portion of the element, and the element resistance rechecked to show a further marked enhancement.

Evaluation of the treated elements for satisfactory ductility to validate the sufficiency of the annealing process was carried out by performing test bending of the treated elements.

Further checks, by way of Rockwell hardness testing, showed that samples annealed at 700 degrees for four hours possessed the requisite ductility for achieving short radius bends, and possessed Rockwell hardness of 70.3 in the 15T Rockwell scale, and 36 on the 30T Rockwell scale. This contrasted with comparative values of 69.5 and 34 Rockwell values (on the respective 15T and 30T Rockwell scales) for elements annealed at 1200 degrees F. for a time of 15 minutes.

In the case of an element which was annealed at a temperature below 700 degrees F., and which had cracked under a short radius bend test, the Rockwell hardness was found to be 82.7 Rockwell and 61.5 Rockwell, on the Rockwell 15T and 30T scales respectively.

Tests carried out with rodded elements annealed at 650 degrees F., some for 2 hours, some at 4 hours, produced elements which were not all unacceptable, but many of which were not sufficiently ductile to consistently provide satisfactory short radius bends substantially without necking.

The above described embodiments, of course, are not to be construed as limiting the breadth of the present invention. Modifications, and other alternative constructions, will be apparent which are within the spirit and scope of the invention as defined in the appended claims.

What is claimed is:

1. A process for fabricating a copper sheathed electrical resistance heating element having a protective copper sheath enclosing a resistance element, comprising the steps of:

treating powdered insulation filler by admixing a predetermined quantity of silicone water-proofing agent with the powdered insulation;

filling the sheath with the powdered insulation in thermal and electrical insulating relation between the resistance element and the sheath;

densifying the powdered insulation by compression, said predetermined quantity of silicone water-proofing agent being sufficient to substantially preclude any subsequent establishment of moisture-initiated short circuit tracks in the insulation;

annealing the copper sheath by heating the sheath to 700 degrees F. for a period of four hours; and cold bending the annealed sheath.

2. The process as set forth in claim 1, wherein said powdered insulation filler comprises magnesium oxide, and said silicone agent comprises polydimethylsiloxane.

3. A method of making a sheathed electrical resistance heating element having a protective copper sheath enclosing an electrical resistance element, comprising the steps of:

threading the electrical resistance element through the copper sheath;

filling the sheath with insulation material between the electrical resistance element and the sheath, said insulation material consisting essentially of an admixture of powdered magnesium oxide and low viscosity polydimethylsiloxane fluid, said polydimethylsiloxane being present in the range of 0.1 to 0.15 percent by weight;

densifying the insulation material by compression thereof between the sheath and the electrical resistance element; and annealing the copper sheath, said annealing comprising heating the sheath to 700 degrees F. for four hours.

4. The method of claim 3, further including the step of sealing outer ends of the sheathed heating element with circuit board sealer.

5. The method of claim 3, wherein said densifying step comprises draw-extrusion of the sheath to a reduced sheath diameter.

6. The method of claim 3, further including the step of cold bending the sheathed heating element into a serpentine form.

7. The method of claim 6, further including the step of installing the serpentine form sheated heating element into a kettle.

8. A method of making a heating element for an electric kettle, comprising the steps of:

threading an electrical resistance wire through a copper sheath;

filling the sheath with insulation material consisting essentially of an admixture of powdered magnesium oxide and low viscosity polydimethylsiloxane fluid, said polydimethylsiloxane being present in the range of 0.1 to 0.15 percent by weight;

draw-extruding the sheath to effect reduction in diameter thereof and compression of the insulation material between the sheath and the wire;

annealing the copper sheath, said annealing comprising heating the sheath to 700 degrees F. for four hours; and cold bending the annealed sheath into a serpentine form containing at least one bend having a radius of curvature of the order of three eighths of an inch.

9. In an electric kettle, a sheathed heating element, comprising:

an outer sheath of annealed copper;

said sheath being of serpentine form and including at least one bend having a radius of curvature of the order of three eighths of an inch;

an electric resistive wire extending through said sheath and extending from the ends thereof;

a powdered insulative material being disposed and compressed between said sheath and said wire and electrically insulating said wire from said sheath;

said insulative material consisting essentially of an admixture of magnesium oxide and polydimethylsiloxane water-proofing agent; and said polydimethylsiloxane water-proofing agent being present in the range of 0.1 to 0.15 percent by weight of the weight of the magnesium oxide.

* * * * *